US009194351B2

(12) United States Patent
Albrodt et al.

(10) Patent No.: US 9,194,351 B2
(45) Date of Patent: Nov. 24, 2015

(54) INJECTION VALVE

(75) Inventors: Hartmut Albrodt, Tamm (DE); Andreas Krause, Unterriexingen (DE); Martin Stahl, Remseck (DE)

(73) Assignee: ROBERT BOSCH GMBH, Stuttgart (DE)

( * ) Notice: Subject to any disclaimer, the term of this patent is extended or adjusted under 35 U.S.C. 154(b) by 53 days.

(21) Appl. No.: 13/976,168

(22) PCT Filed: Nov. 9, 2011

(86) PCT No.: PCT/EP2011/069713
§ 371 (c)(1),
(2), (4) Date: Sep. 12, 2013

(87) PCT Pub. No.: WO2012/089391
PCT Pub. Date: Jul. 5, 2012

(65) Prior Publication Data

US 2014/0001288 A1 Jan. 2, 2014

(30) Foreign Application Priority Data

Dec. 28, 2010 (DE) ..... 10 2010 064268

(51) Int. Cl.
*F02M 61/16* (2006.01)
*F02M 61/18* (2006.01)

(52) U.S. Cl.
CPC ..... *F02M 61/186* (2013.01); *F02M 61/162* (2013.01); *F02M 61/1806* (2013.01); *F02M 61/1853* (2013.01)

(58) Field of Classification Search
CPC ..... F02M 61/162; F02M 61/1806; F02M 61/1853; F02M 61/186
USPC ..... 239/490, 491, 494, 496, 497, 533.3, 239/533.12, 584, 585.1, 585.4, 601
See application file for complete search history.

(56) References Cited

U.S. PATENT DOCUMENTS

| | | | | |
|---|---|---|---|---|
| 5,785,254 | A * | 7/1998 | Zimmermann et al. | 239/490 |
| 6,170,763 | B1 * | 1/2001 | Fuchs et al. | 239/533.12 |
| 6,708,904 | B2 * | 3/2004 | Itatsu | 239/533.12 |
| 7,472,838 | B2 * | 1/2009 | Omura et al. | 239/88 |
| 8,231,069 | B2 * | 7/2012 | Matsumura et al. | 239/533.12 |

(Continued)

FOREIGN PATENT DOCUMENTS

| | | |
|---|---|---|
| CN | 1118181 A | 3/1996 |
| CN | 1147844 A | 4/1997 |
| DE | 41 21 310 | 1/1992 |

(Continued)

*Primary Examiner* — Ryan Reis
(74) *Attorney, Agent, or Firm* — Kenyon & Kenyon LLP

(57) ABSTRACT

An injection valve for injecting a liquid includes an electromagnetic actuator and a movable valve needle and a valve closing element that with a valve seating surface forms a sealing seat, and includes a perforated disc situated downstream from the sealing seat, the perforated disc having at least one inlet area and at least one outlet opening. An upper functional plane having the at least one inlet area has a different opening geometry in cross-section than a lower functional plane having the at least one outlet opening. The perforated disc has inlet areas, each provided, as a locally limited cavity, with a rectangular or bathtub-shaped contour, a respective outlet opening going out from each in the direction of flow, the outlet openings, going out from the midpoint of the respective inlet areas, and drawing an imaginary longitudinal axis and transverse axis through these, having an asymmetry as to both axes.

11 Claims, 3 Drawing Sheets

(56) References Cited

U.S. PATENT DOCUMENTS

| | | | | |
|---|---|---|---|---|
| 2003/0116650 | A1 | 6/2003 | Dantes et al. | |
| 2004/0144870 | A1* | 7/2004 | Tani et al. | 239/585.1 |
| 2004/0217204 | A1 | 11/2004 | Sugimoto et al. | |
| 2009/0206181 | A1* | 8/2009 | Arndt et al. | 239/533.12 |
| 2010/0288857 | A1* | 11/2010 | Hashii et al. | 239/585.1 |

FOREIGN PATENT DOCUMENTS

| | | |
|---|---|---|
| DE | 100 48 935 | 4/2002 |
| JP | 2000508739 | 7/2000 |
| JP | 2004510915 | 4/2004 |
| JP | 2005054656 | 3/2005 |
| JP | 2010265865 | 11/2010 |

* cited by examiner

INJECTION VALVE

FIELD OF THE INVENTION

The present invention is based on an injection valve.

BACKGROUND INFORMATION

German patent document DE 41 21 310 A1 discusses a fuel injection valve that has a valve seating element on which a fixed valve seat is fashioned. A valve closing element that is axially movable in the injection valve works together with this valve seat fashioned in the valve seating element. In the downstream direction, the valve seating element has connected to it a flat orifice director plate in which there is provided, facing the valve seat, an H-shaped recess as an inlet area. In the downstream direction, four injection orifices are connected to the H-shaped inlet area, so that a fuel that is to be injected can be distributed, via the inlet area, to the injection orifices. Here, the valve seating element is not intended to influence the flow geometry in the nozzle directing plate. Rather, a passage of flow downstream from the valve seat in the valve seating element is carried out to such an extent that the valve seating element has no influence on the opening geometry of the orifice director plate.

German patent document DE 100 48 935 A1 discusses a fuel injection valve for fuel injection systems in internal combustion engines is known that has an actuator and a movable valve part that in order to open and close the valve works together with a fixed valve seat that is fashioned on a valve seating element. Downstream from the valve seat there is situated a disc-shaped swirl element that has at least one inlet area and also at least one outlet opening, and that has at least one swirl channel upstream from the outlet opening. The flow into the inlet area in the swirl element takes place centrally. All the swirl channels go out from the swirl element, so that a swirl component is impressed on the fuel, which flows through the swirl channels exclusively radially from the inside toward the outside.

SUMMARY OF THE INVENTION

The injection valve according to the present invention having the features described herein has the advantage that from the outlet openings there is emitted, in an economical manner, a hollow cone spray that provides a very good atomization quality with regard to its lamella breakup. Particularly in the case of injection valves that emit a fluid at low pressure, according to the present invention the atomization quality can be further increased, because here, given a configuration of the injection valve as a multi-hole valve, the atomization quality is improved by a swirl effect that is produced in a highly optimized manner via the contour shaping. Above all, for multi-hole injection valves used in the low-pressure range, a configuration according to the present invention is ideally suitable due to simple increase of turbulence.

Through the measures indicated in the subclaims, advantageous developments and improvements of the injection valve indicated in the main claim are possible.

It is advantageous that the hole length of the outlet openings, or the length/diameter ratio, has a significantly smaller influence on the atomization quality than is for example the case for known turbulence atomization in pure "spring wind-up valves." This is because the swirl movement produced in the inlet areas is broken down only very slightly over the hole length, in contrast to the turbulence.

Exemplary embodiments of the present invention are shown in simplified fashion in the drawing, and are explained in more detail in the following description.

DETAILED DESCRIPTION

Figure 1:
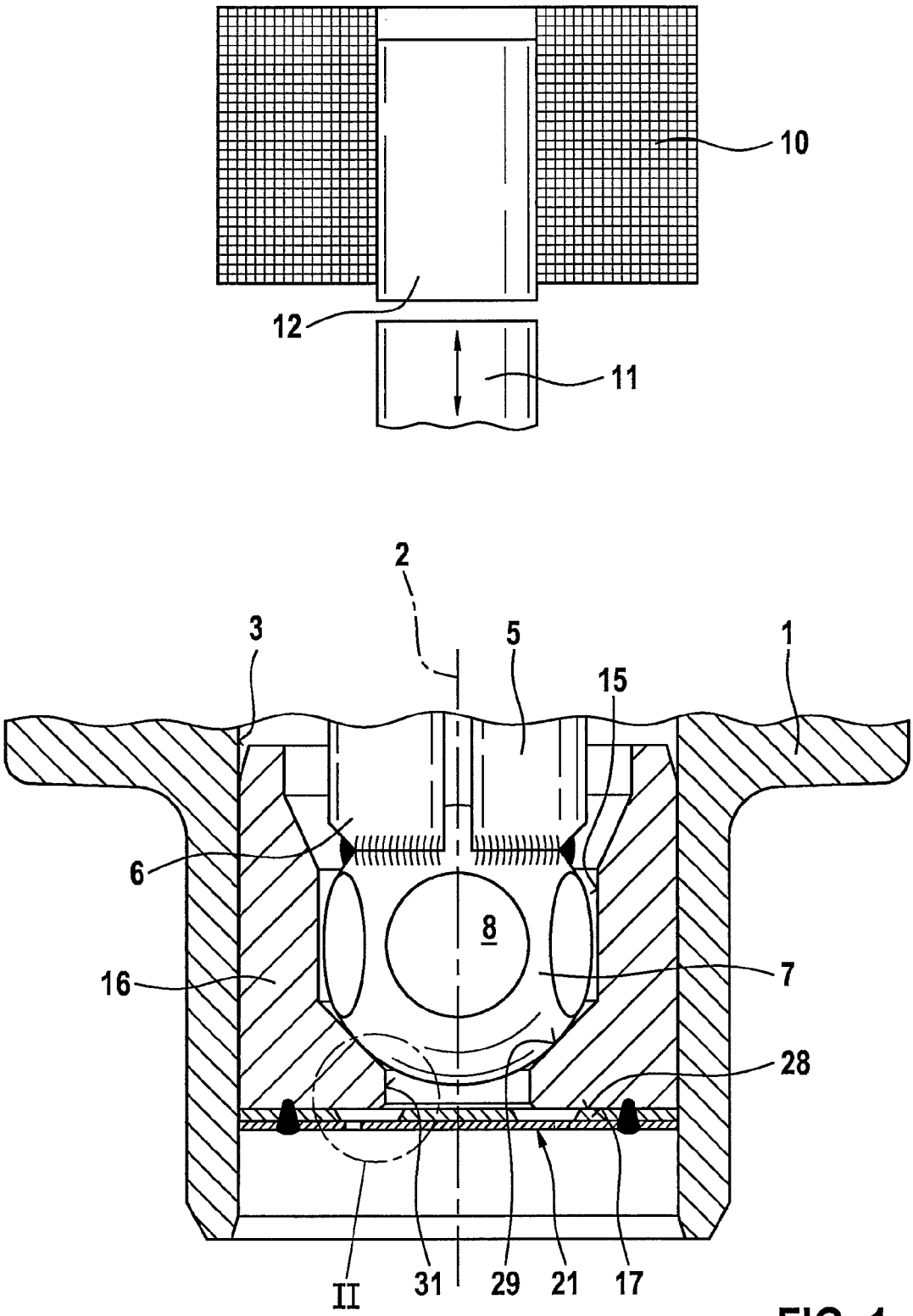
FIG. 1 shows a partial depiction of an injection valve having a first perforated disc downstream from the valve seating element.

FIG. 1 shows, as an exemplary embodiment, a partial view of a valve in the form of an injection valve for fuel injection systems of mixture-compressing spark-ignited internal combustion engines. The injection valve has a tube-shaped valve seat bearer 1, in which a longitudinal opening 3 is fashioned concentrically to a valve longitudinal axis 2. In longitudinal opening 3 there is situated an e.g. tube-shaped valve needle 5 that is fixedly connected at its downstream end 6 to an e.g. spherical valve closing element 7 on whose circumference there are provided for example five flattened areas 8 past which the fuel can flow.

However, it is explicitly noted that the configuration according to the present invention of the injection area is described only as an example on the basis of such a fuel injection valve; the present invention can however also be realized for fuel injection valves for direct injection, or also for injection valves for introducing aqueous urea solutions (e.g. AdBlue™) into the exhaust gas train of internal combustion engines or the like.

The injection valve is actuated in an available manner, for example, electromagnetically. For the axial movement of valve needle 5, and thus for the opening of the injection valve against the spring force of a reset spring (not shown), or for the closing of the injection valve, a schematically indicated electromagnetic circuit is used having a magnetic coil 10, an armature 11, and a core 12. Armature 11 is connected to the end of valve needle 5 facing away from valve closing element 7 by a weld seam, formed for example using a laser, and is oriented toward core 12.

Instead of an electromagnetic actuator, a piezoelectric, magnetostrictive, or some other drive may also be used to actuate valve closing element 7.

In order to guide valve closing element 7 during the axial movement, a guide opening 15 of a valve seating element 16 is used that is tightly mounted, by welding, in the downstream end, facing away from core 12, of valve seating bearer 1, in longitudinal opening 3 running concentrically to valve longitudinal axis 2. At its lower end face 17, facing away from valve closing element 7, valve seating element 16 is fixedly connected to a perforated disc 21.

Figure 2:
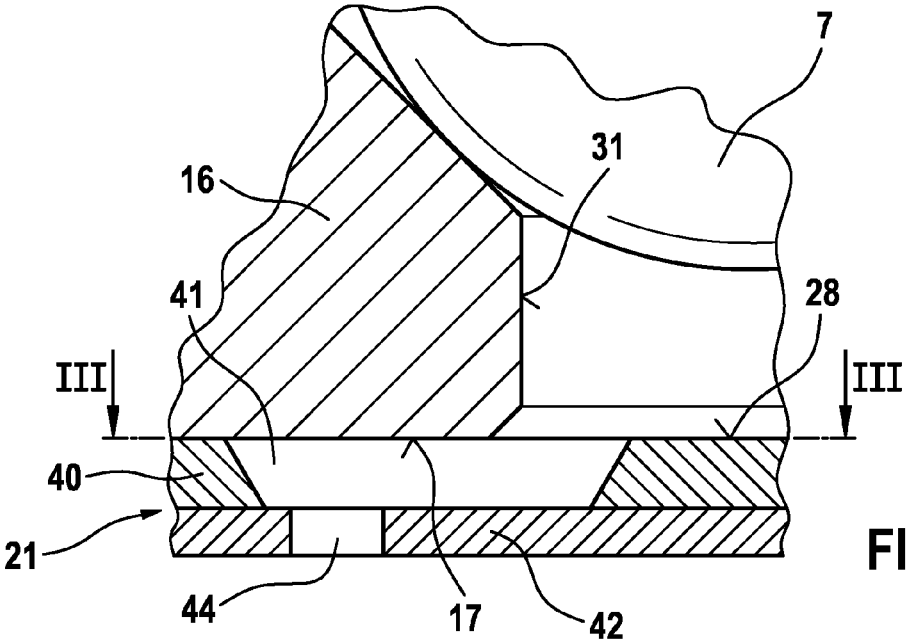
FIG. 2 shows a detail II from FIG. 1 in an enlarged scale.

Perforated disc 21 is made with two layers, such that the two layers can be made in a single perforated disc 21, but perforated disc 21 can also be made up of two perforated disc parts placed one on the other, as is identified in FIG. 2 by the differing hatching.

With an upper end surface 28, perforated disc 21 abuts lower end surface 17 of valve seating element 16. Perforated disc 21 has two functional planes. Here each functional plane is intended to have a largely constant opening contour over its axial extension, so that in particular the next functional plane has a different opening contour.

The insertion depth of the valve seating part, made up of valve seating element 16 and perforated disc 21, into longitudinal opening 3 determines the size of the stroke of valve needle 5, because when magnetic coil 10 is not excited the one end position of valve needle 5 is determined by the seating of valve closing element 7 on a valve seating surface 29, which tapers conically in the downstream direction, of valve seating element 16. When magnetic coil 10 is excited, the other end position of valve needle 5 is determined for example by the seating of armature 11 on core 12. The path between these two end positions of valve needle 5 thus represents the stroke. Spherical valve closing element 7 works together with frustum-shaped valve seating surface 29 of valve seating element 16, which valve seating surface is fashioned in the axial direction between guide opening 15 and a lower cylindrical outlet opening 31 of valve seating element 16 that extends up to end surface 17.

Perforated discs 21 shown in FIGS. 1 through 7 can for example be built up in two metallic functional planes through galvanic deposition. Other ways of producing perforated disc 21 are also conceivable. Thus, it is also possible to use two thin plate layers into which the desired contours are impressed.

Figure 3:
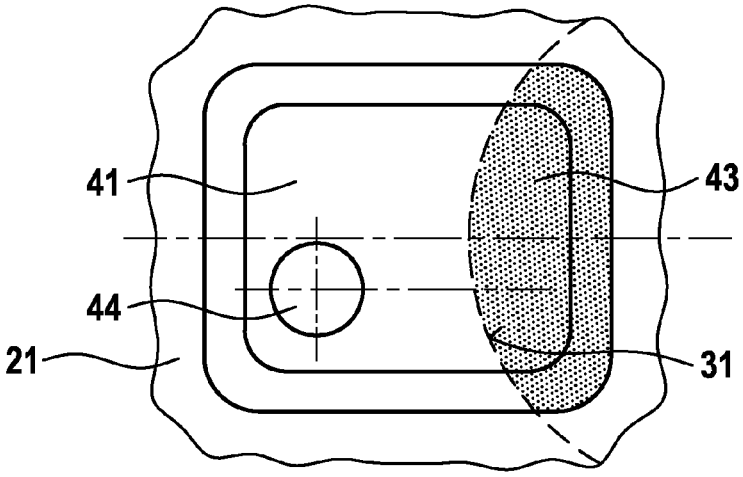
FIG. 3 shows a top view of a partial area of the perforated disc as a section along the line in FIG. 2.

As a first exemplary embodiment of a perforated disc 21 according to the present invention, FIG. 2 shows detail II in FIG. 1 in an enlarged view. Perforated disc 21 is realized for example as a flat circular component that has the two already-mentioned functional planes succeeding one another axially. In an upper functional plane 40, perforated disc 21 has a plurality of inlet areas 41 to which the liquid flow coming from outlet opening 31 flows immediately. As can be seen in FIG. 3, as a top view of an inlet area 41, region of overlap 43 of outlet opening 31 and inlet area 41 is at most one-third of the surface of inlet area 41. However, region of overlap 43 should itself be large enough that an excess throttling of the liquid during its entry into inlet area 41 is avoided. For this reason, region of overlap 43 should be at least as large as the cross-section of inlet area 41.

Figure 4:
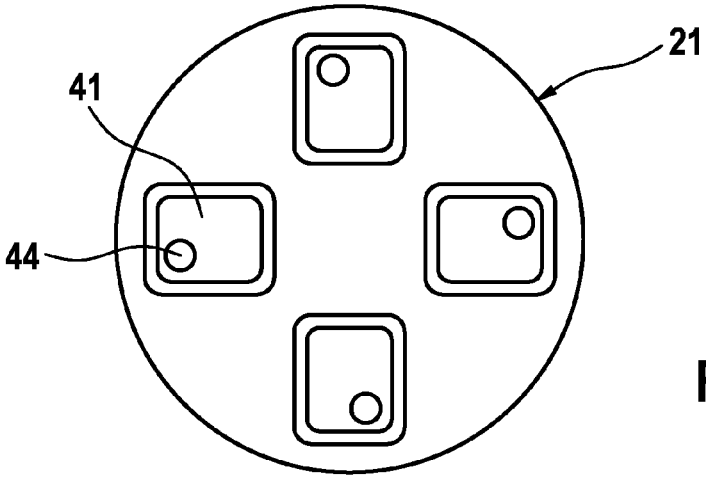
FIG. 4 shows a top view of a complete first perforated disc.

As a locally limited cavity, inlet area 41 in upper functional plane 40, which according to FIG. 4 can for example be oriented four times at a right angle to one another, is distinguished by a rectangular or bathtub-shaped contour, the longitudinal extension of rectangular inlet area 41 running in the radial direction in perforated disc 21. It is also possible for example for two, three, five, or six, or even more inlet areas 41 to be provided. The circumferential side wall of inlet area 41 is for example inclined obliquely in the manner of a bathtub, formed so as to run with a conicity. In a second lower functional plane 42, there is made an outlet opening 44 allocated to each inlet area 41. Outlet openings 44 are formed for example as circular injection holes.

According to the present invention, inlet areas 41 in perforated disc 21 are configured such that the speed of the liquid flowing in in inlet area 41, and thus the speed at which the flow arrives at outlet opening 44, is very high, but that no excessive throttling occurs. Outlet opening 31 has a diameter significantly smaller than that of an imaginary circle on which lie outlet openings 44 of perforated disc 21. In other words, there is a complete offset of outlet opening 31, which determines the inlet of perforated disc 21, and outlet openings 24. In a projection of valve seating element 16 onto perforated disc 21, valve seating element 16 thus covers all the outlet openings 44. Due to the radial offset of outlet openings 44 relative to outlet opening 31, there results an S-shaped course of the flow of the fluid.

The relation between the radio and the axial flow to outlet openings 44 is influenced by the spacing between the wall of outlet opening 31 in valve seating element 16 and outlet openings 44. The radial flow to the outlet openings is strengthened as the spacing becomes larger, while the axial flow components thereto are weakened. The fluid stream has the tendency to tilt accordingly more in the radial direction, thus increasing the jet angle of the overall spray as the spacing of outlet opening 31 from outlet openings 44 is chosen to be larger. In addition to the cross-sectional relations, the swirl intensity is also decisively controlled via the eccentricity of outlet openings 44 relative to inlet areas 41.

FIGS. 3 and 4 illustrate that outlet openings 44, going out from the midpoint of the respective inlet areas 41 and drawing an imaginary longitudinal axis and transverse axis through these, have an asymmetry with regard to both axes. For this reason, for each outlet opening 44 there is an offset in both directions relative to the two axes of its inlet area 41. The corners of inlet areas 41 can be rounded as shown in FIG. 3.

Figure 5:
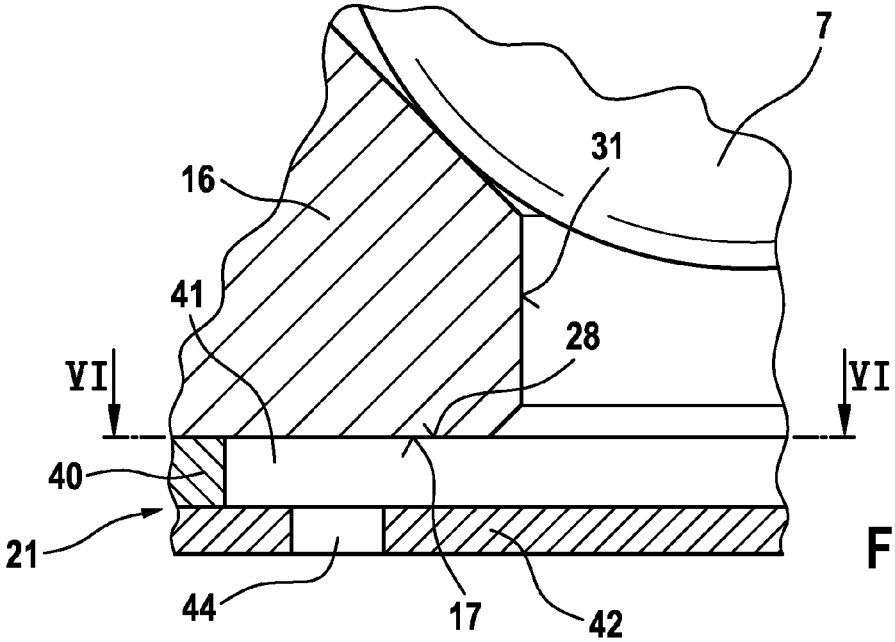
FIG. 5 shows a detail analogous to the representation shown in FIG. 2 in order to illustrate an alternative exemplary embodiment.
Figure 6:
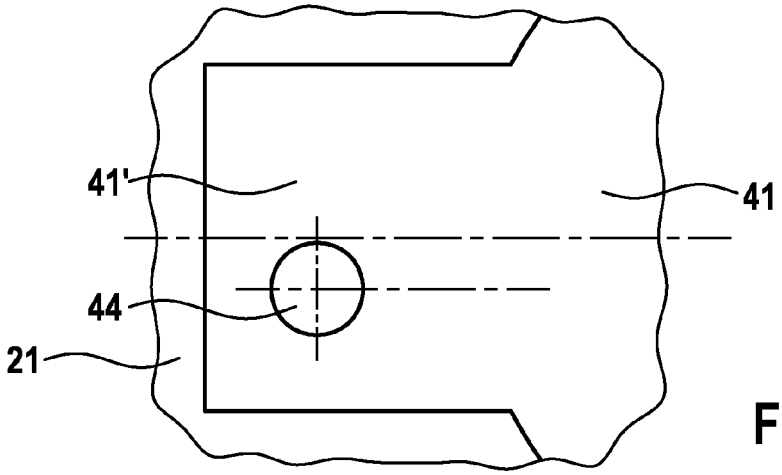
FIG. 6 shows a top view of a partial area of the perforated disc as a section along the line VI-VI in FIG. 5.
Figure 7:
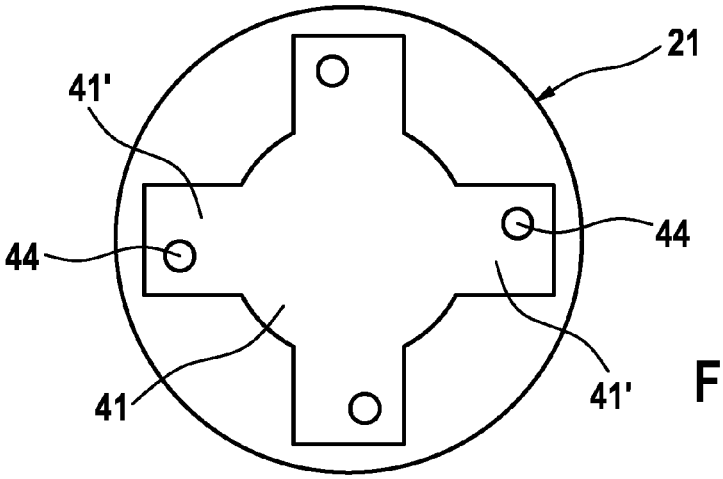
FIG. 7 shows a top view of a complete second perforated disc.

FIGS. 5 through 7 show an alternative exemplary embodiment of a perforated disc 21 according to the present invention. Here, in upper functional plane 40 of perforated disc 21 there is formed only one inlet area, which has a rectangular partial contour 41' only close to outlet openings 44. FIG. 7, a top view of a complete second perforated disc 21, illustrates that inlet area 41 is largely circular in its interior, to which rectangular partial contours 41' are connected, towards the flow to outlet openings 44, so as to be directed radially outward; one of these partial contours is shown as an enlarged detail in FIG. 6. The statements made above in relation to the first exemplary embodiment concerning the influencing of flow and speed also hold correspondingly for the second exemplary embodiment.

Inlet area 41 with partial contours 41' in upper functional plane 40, which according to FIG. 7 can be situated for example four times at a right angle to one another, is again distinguished, by this particular contouring, as a multiply locally limited cavity having a rectangular or bathtub-shaped contour. The circumferential side wall of inlet area 41, and of rectangular partial contours 41', are in this example for example formed so as to run in perpendicular fashion. In second lower functional plane 42, there is made an outlet opening 44 allocated to each inlet area 41'. Outlet openings 44 are formed for example as circular injection holes.

FIGS. 6 and 7 illustrate that outlet openings 44, going out from the midpoint of the respective inlet areas 41', and drawing an imaginary longitudinal axis and transverse axis through these, have an asymmetry with respect to both axes. For this reason, for each outlet opening 44 there is an offset in both directions relative to the two axes of its inlet area 41'.

What is claimed is:

1. An injection valve for injecting a liquid, comprising:

an actuator;

a movable valve component;

a valve closing element, which forms with a valve seating surface a sealing seat, and having a perforated disc situated downstream from the sealing seat, the perforated disc having at least one inlet area and at least one outlet opening, an upper functional plane having the at least one inlet area having a different opening geometry in cross-section than does a lower functional plane that has the at least one outlet opening; and a valve seating element, having the valve seating surface, contacts and partially covers the inlet areas of the perforated disc with a lower end surface so that the outlet openings are covered by the valve seating element;

wherein a plurality of inlet areas, each provided as a locally limited cavity, are each provided with a rectangular or bathtub-shaped contour, from each of which there goes out an outlet opening in the direction of flow, the outlet openings, going out from the midpoint of the respective inlet areas, an imaginary longitudinal axis and transverse axis being through these, having an asymmetry relative to both of the axes, and wherein the walls of the inlet areas run so as to be obliquely inclined.

2. The injection valve of claim 1, wherein two to six inlet areas are provided in the perforated disc.

3. The injection valve of claim 1, wherein an inlet area includes a plurality of rectangular or bathtub-shaped partial contours, the partial contours being connected, directed radially outwardly, to an inner inlet area for the flow to the outlet openings.

4. The injection valve of claim 1, wherein the outlet openings are formed so as to be circular.

5. The injection valve of claim 1, wherein, using galvanic deposition, the perforated disc is made with a two-layer construction having the two functional planes, but is made in one piece.

6. The injection valve of claim 1, wherein the perforated disc is made up of two thin plate layers situated one on the other.

7. The injection valve of claim 1, wherein two to six inlet areas are provided in the perforated disc, and wherein the walls of the inlet areas run so as to be obliquely inclined or perpendicular.

8. The injection valve of claim 1, wherein two to six inlet areas are provided in the perforated disc, and wherein an inlet area includes a plurality of rectangular or bathtub-shaped partial contours, the partial contours being connected, directed radially outwardly, to an inner inlet area for the flow to the outlet openings.

9. The injection valve of claim 8, wherein the outlet openings are formed so as to be circular.

10. The injection valve of claim 7, wherein, using galvanic deposition, the perforated disc is made with a two-layer construction having the two functional planes, but is made in one piece.

11. The injection valve of claim 7, wherein the perforated disc is made up of two thin plate layers situated one on the other.

* * * * *